US008978883B2

(12) United States Patent
Gandhi et al.

(10) Patent No.: US 8,978,883 B2
(45) Date of Patent: Mar. 17, 2015

(54) ELECTRONIC DEVICE CASE WITH A CO-MOLDED STAND

(71) Applicant: Fellowes, Inc., Itasca, IL (US)

(72) Inventors: Harsh Gandhi, Carol Stream, IL (US); Taiwon Choi, Glenview, IL (US)

(73) Assignee: Fellowes, Inc., Itasca, IL (US)

( * ) Notice: Subject to any disclaimer, the term of this patent is extended or adjusted under 35 U.S.C. 154(b) by 0 days.

(21) Appl. No.: 14/174,792

(22) Filed: Feb. 6, 2014

(65) Prior Publication Data

US 2014/0262855 A1 Sep. 18, 2014

Related U.S. Application Data

(60) Provisional application No. 61/788,497, filed on Mar. 15, 2013.

(51) Int. Cl.

| | |
|---|---|
| ***B65D 5/52*** | (2006.01) |
| ***B65D 25/24*** | (2006.01) |
| ***A45C 11/00*** | (2006.01) |

(52) U.S. Cl.

CPC ..... *A45C 11/00* (2013.01)
USPC ..... 206/45.24; 206/320

(58) Field of Classification Search

USPC ..... 206/320, 576, 45.2, 45.24, 701
See application file for complete search history.

(56) References Cited

U.S. PATENT DOCUMENTS

| | | | | |
|---|---|---|---|---|
| 8,706,176 | B1 * | 4/2014 | Jia et al. | 455/575.8 |
| 8,714,347 | B2 * | 5/2014 | Mongan et al. | 206/45.24 |
| 8,800,762 | B2 * | 8/2014 | Fathollahi | 206/320 |
| 2012/0031788 | A1 * | 2/2012 | Mongan et al. | 206/320 |
| 2012/0199501 | A1 * | 8/2012 | Le Gette et al. | 206/45.24 |
| 2013/0098788 | A1 * | 4/2013 | McCarville et al. | 206/320 |
| 2013/0206621 | A1 * | 8/2013 | Bau | 206/320 |
| 2013/0264235 | A1 * | 10/2013 | Lin | 206/320 |

* cited by examiner

*Primary Examiner* — Jacob K Ackun
(74) *Attorney, Agent, or Firm* — Pillsbury Winthrop Shaw Pittman LLP

(57) ABSTRACT

A case for use with a portable electronic device includes a first material configured to surround a back portion and side portions of the portable electronic device, the first material generally being positioned at an exterior of the case. The case also includes a second material secured to the first material, the second material having greater flexibility than the first material. The case additionally includes a movable stand configured to selectively extend from the first material to support the case in an elevated position. The movable stand is coupled to the first material by the second material.

19 Claims, 11 Drawing Sheets

ELECTRONIC DEVICE CASE WITH A CO-MOLDED STAND

This application claims the benefit of provisional U.S. Patent Application 61/788,497, filed on Mar. 15, 2013, which is incorporated herein by reference in its entirety.

BACKGROUND

1. Field

The present disclosure is generally related to a case for use with a portable electronic device. More specifically, the disclosure relates to a case configured to protect the electronic device from impacts or abrasions.

2. Background

Some cases for portable electronic devices, such as cellular phones and personal digital assistants (PDAs), for example, have hard exterior surfaces with low coefficients of friction. Such exterior surfaces may facilitate insertion and removal of the case (and electronic device therein) from a user's pocket. Other cases are formed from a softer cushioning material, tending to have a relatively high coefficient of friction, which may provide greater impact protection to the electronic device. Among other things, the present application discloses improvements to cases for electronic devices.

SUMMARY

According to an embodiment, a case for use with a portable electronic device includes a first material configured to surround a back portion and side portions of the portable electronic device, the first material generally being positioned at an exterior of the case. The case also includes a second material secured to the first material, the second material having greater flexibility than the first material. The case additionally includes a movable stand configured to selectively extend from the first material to support the case in an elevated position. The movable stand is coupled to the first material by the second material.

Other features and advantages of the present invention will become apparent from the following detailed description, and the accompanying drawings.

BRIEF DESCRIPTION OF THE DRAWINGS

Embodiments will now be described, by way of example only, with reference to the accompanying drawings in which corresponding reference symbols indicate corresponding parts, and in which.

DETAILED DESCRIPTION OF THE ILLUSTRATED EMBODIMENT(S)

Figure 1:
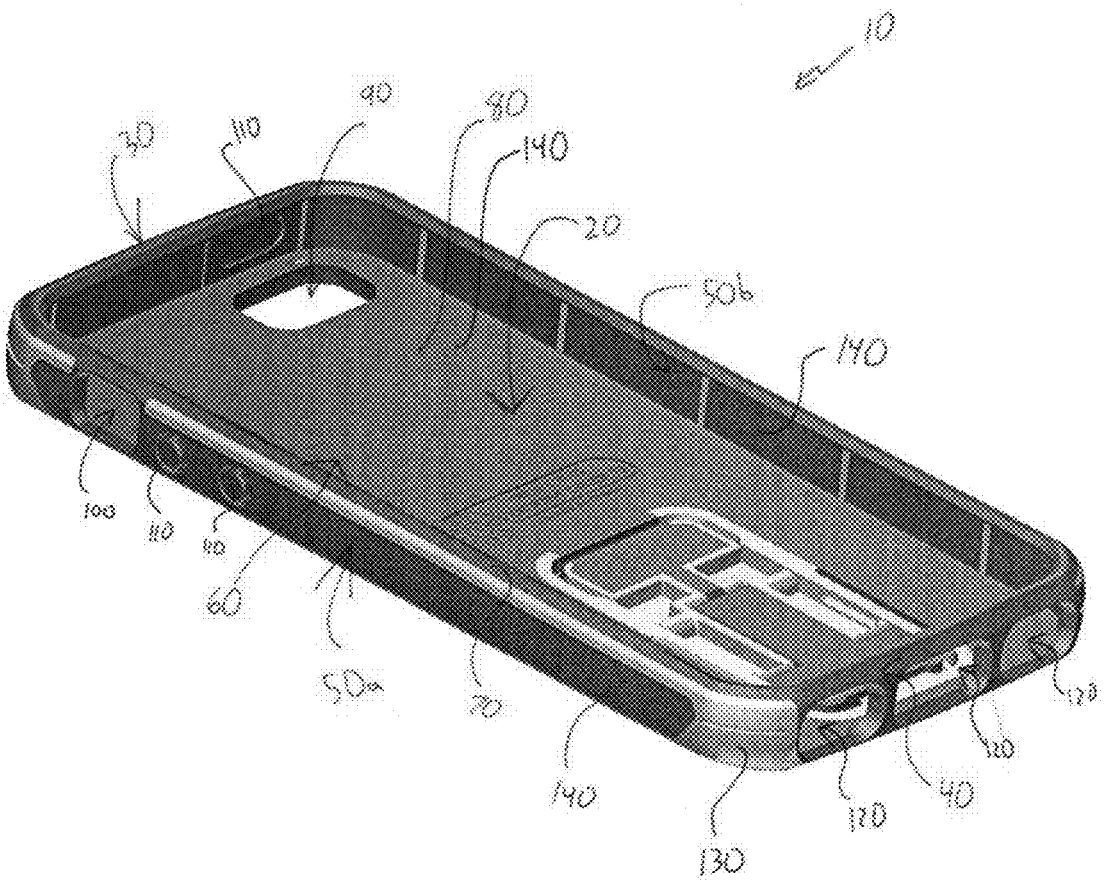
FIG. 1 illustrates a perspective view of an embodiment of an electronic device case.

FIG. 1 illustrates a perspective view of a case 10 in accordance with an embodiment of the present invention. The case 10 includes a base 20 with sides extending away therefrom, configured to form a pocket to receive a portable electronic device therein. Specifically, in the illustrated embodiment, a top 30, a bottom 40, a left side 50*a* and a right side 50*b* are coupled to the base 20, and define a volume of space in the pocket that may receive the portable electronic device therein. It may be appreciated that the case 10 may be configured to house a variety of portable electronic devices across various embodiments, including but not limited to a cellular phone, PDA, music player (e.g., MP3 player), tablet, gaming device, remote control, and the like.

As shown, the top 30, bottom 40, left side 50*a*, and right side 50*b* may define an opening 60 to the pocket. In an embodiment, the opening 60 may be surrounded by a lip 70 at the perimeter of the opening 60, which may be deformable to allow the portable electronic device to enter into the pocket via the opening 60, and retain the portable electronic device therein. Accordingly, in an embodiment an interior surface 80 of the base 20, as well as interior surfaces of the top 30, bottom 40, left side 50*a*, right side 50*b*, and the lip 70, may surround the pocket. In an embodiment, a display screen and/or a user interface of the portable electronic device may face away from the pocket (e.g., may be framed at least partially by the lip 70). As described in greater detail below, the lip 70 may be formed of an elastic or otherwise resiliently deformable material, which may facilitate expanding the opening 60 to receive the portable electronic device within the pocket. It may be appreciated that other configurations of the case 10 may alternatively be possible, including but not limited to cases having multiple components that are separable from each other. For example, slider cases are generally configured with separable pieces that each slide over the portable electronic device, and engage one another (e.g., with a snap fit or friction fit) to secure the portable electronic device therein.

It may be appreciated that the case 10 may have features or apertures formed therein, configured to correspond with features on the portable electronic device. For example, as shown in FIG. 1, an aperture 90 may extend through the base 20, and may be configured to align with a camera lens on the electronic device. In some embodiments, the aperture 90 may be sized to additionally or alternatively align with a camera flash on the electronic device. In some embodiments, additional apertures may extend through the base 20, so as to align with other features, including but not limited to marketing insignias on the portable electronic device. It may also be appreciated that in some embodiments one or more of the apertures may be merely decorative (e.g., with a repetitive or randomized pattern of apertures formed across at least a portion of the case 10).

Figure 2:
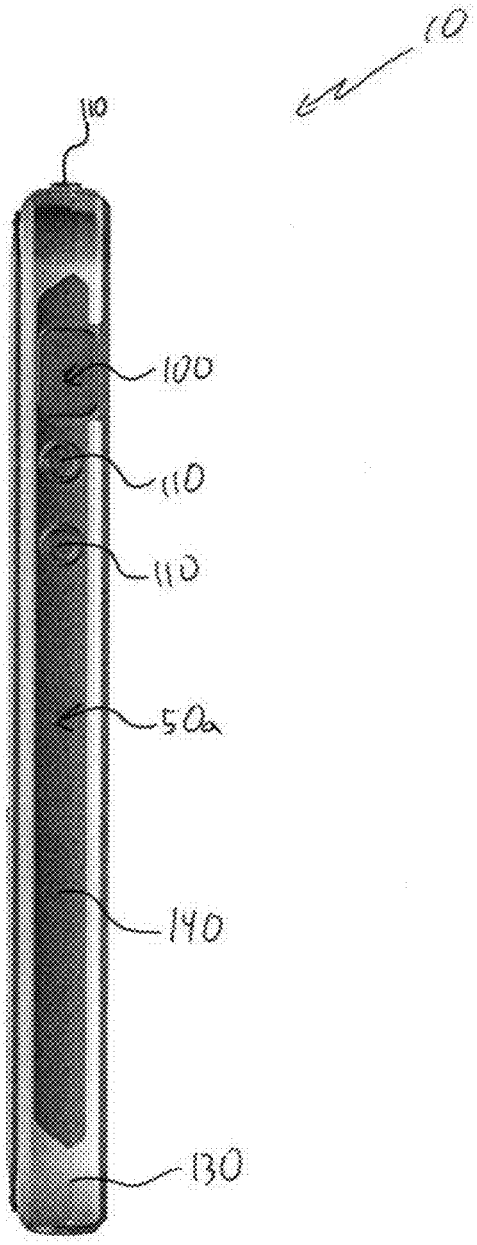
FIG. 2 illustrates a left side view of the electronic device case of FIG. 1.
Figure 3:
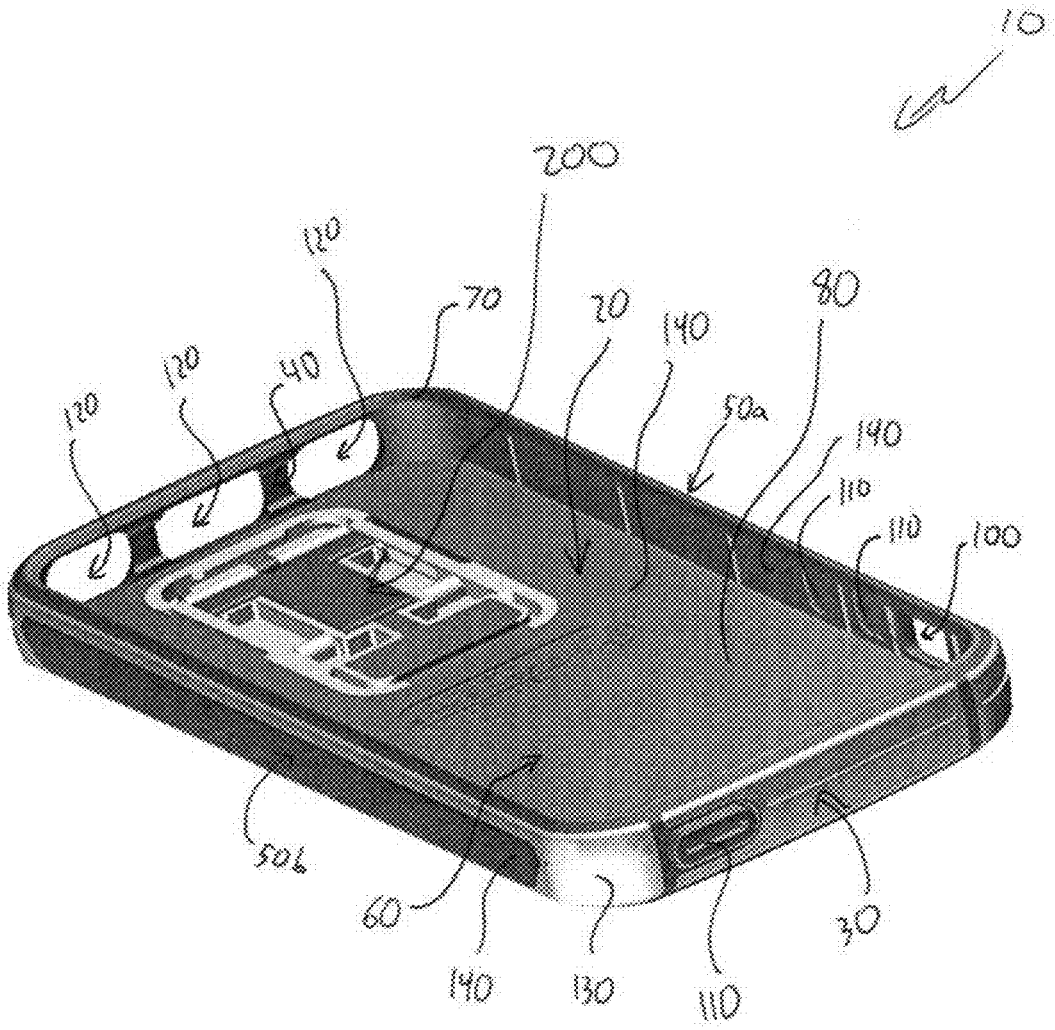
FIG. 3 illustrates another perspective side view of the electronic device case of FIG. 1.

The perspective view of FIG. 1 illustrates that in an embodiment the left side 50*a* of the case 10 may include an aperture 100 configured to align with a switch (e.g., a mute switch) on the portable electronic device. Similarly, the left side 50*a* of the case 10 may include buttons 110 configured to align with buttons (e.g., volume buttons) on the portable electronic device. These features are also visible in the side view of FIG. 2, facing the left side 50*a* of the case 10. The buttons 110 are optional in some embodiments, and additional apertures 100 may be positioned to align with the buttons of the portable electronic device in other embodiments. In an embodiment, the aperture 100 may be sized and position to align with both the switch and the buttons on the portable electronic device. In some embodiments, one or more apertures 100 and/or one or more buttons 110 may be positioned elsewhere on the case 10, including but not limited to on the right side 50*b*. In the illustrated embodiment of the case 10, a button 110 is also formed on the top 30, as is more clearly shown in the perspective view of FIG. 3, illustrating a view from the top 30. In the illustrated embodiment, apertures 120 are also formed at the bottom 40 of the case 10. In an embodiment, the apertures 120 may be positioned to align with data ports, audio ports, speakers, microphones, and or other features of the portable electronic device. In some embodiments, separate apertures may be formed on the same side (e.g., on the bottom 40), associated with different features of the portable electronic device, while in other embodiments a single aperture may be sized and positioned to align with a plurality of features of the portable electronic device.

In some embodiments, the buttons 110 may be mechanical buttons coupled within the case 10 to transmit a press thereon into a press of the buttons of the portable electronic device. In other embodiments the buttons 110 may be formed from a flexible material, facilitating depression of the buttons 110, where such depression of the buttons 110 may be transmitted through the buttons 110 to depress the buttons of the portable electronic device.

Figure 4:
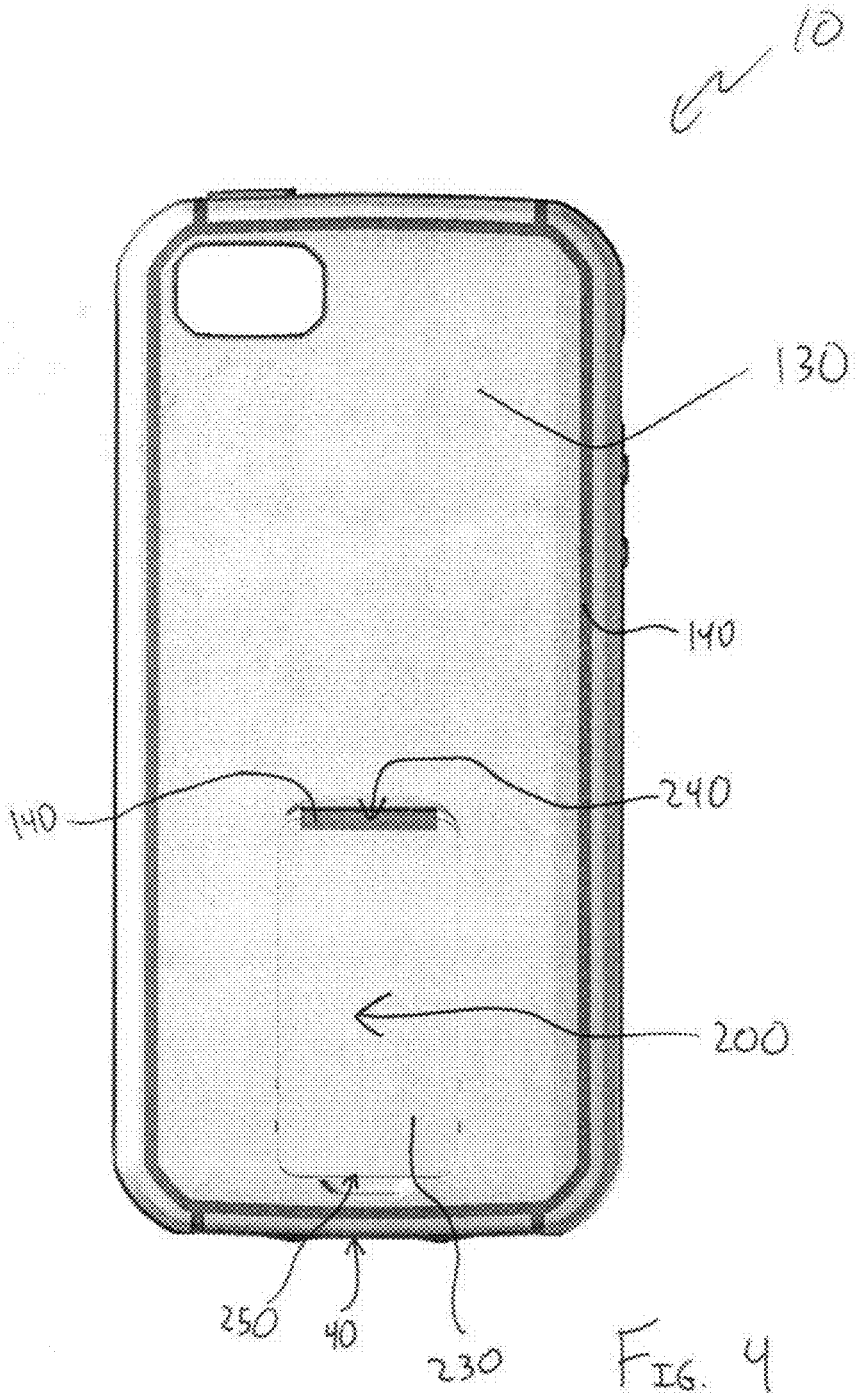
FIG. 4 illustrates a rear view of the electronic device case of FIG. 1.

As described in greater detail below, in an embodiment the case 10 may be primarily formed from two materials, a hard material 130, and a flexible material 140. In the illustrated embodiment, the hard material 130 generally forms an exterior of the case 10, while the flexible material 140 generally forms an interior of the case 10. As shown in FIG. 1, the hard material 130 may generally form a frame for the case 10, which may be supplemented with the flexible material 140, which may provide shock absorption properties, and cushion the portable electronic device within the hard material 130. In the illustrated embodiment, the flexible material 140 may generally be positioned in the interior surface 80 of the base 20, the interior surfaces of the top 30, bottom 40, left side 50*a* and right side 50*b*. In an embodiment, the flexible material 140 may form the lips 70 surrounding the opening 60 of the case 10. It may be appreciated that in some embodiments the lips 70 may also protrude above the opening of the case 10 (e.g., away from a screen of a portable electronic device inserted within the case 10), which may cause the flexible material 140 to extend outward from the hard material 130 in the case 10, which may provide protection to the portable electronic device otherwise exposed by the opening (e.g., at the screen thereof). In an embodiment, the flexible material 140 may additionally be selectively positioned at the exterior of the case 10. For example, in the illustrated embodiment, the flexible material 140 is also positioned at the exterior surface of the left side 50*a* and the right side 50*b*. It may be appreciated that the flexible material 140 may have a higher coefficient of friction than the hard material 130. Therefore, by being positioned at the exterior of the left side 50*a* and right side 50*b* of the case 10, the flexible material 140 may assist a user of the portable electronic device in gripping of the case 10. In some embodiments, the molding process may be configured to shape and define an amount by which the flexible material 140 extends from the sides 50*a* and 50*b* of the case 10. Such shaping of the flexible material 140 may facilitate creation of additional gripping surfaces thereat. Additionally, the flexible material 140 may be positioned or shaped decoratively on the case 10. For example, as shown in FIG. 4, illustrating the rear of the case 10, a perimeter of the hard material 130 may be covered in the flexible material 140. Other positioning of the flexible material 140 on the exterior of the case 10 is alternatively possible.

It may be appreciated that protrusions of the flexible material 140 may protect the hard material 130. For example, where the hard material 130 is glossy or otherwise prone to scratching, the protruding flexible material 140 may space the hard material 130 from support surfaces, reducing a likelihood of the hard material 130 being scratched by the support surface or debris thereon. Additionally, where the flexible material 140 is resilient (e.g. soft and/or elastic), the protruding configuration thereof may provide enhanced impact resistance, such as when the case 10 is dropped and impacts a face or corner thereof. Additionally, the flexible material 140 at the interior 80 of the pocket may provide enhanced impact resistance, and mitigate transmission of impact forces from the hard material 130 to the portable electronic device. This protection may be particularly beneficial where, like in the illustrated embodiment, the hard material 130 is positioned to form the majority of the exterior of the case 10.

The flexible material 140 may be coupled to the hard material 130 by any appropriate mechanism. For example, in some embodiments, the flexible material 140 may be co-molded to the hard material 130. Such co-molding may comprise co-injection molding in some embodiments, wherein the hard material 130 and the flexible material 140 may be integrally formed together to form a one piece assembly. In another embodiment, the co-molding may comprise forming a preform (e.g., of the hard material 130), and overmolding the flexible material 140 over the preform to create a co-molded assembly. In an embodiment, the case 10 is formed from injection-molded plastic or rubber. Other constructions for some or all of the case 10 are additionally or alternatively possible, including but not limited to creating an assembly through a combination of constituent components, assembled through adhesion with an adhesive, interlocking components, or any other appropriate assembly mechanism. Additional details of embodiments of the co-molding and/or of the case 10 may be found in U.S. Provisional Patent Application 61/761,556, incorporated in its entirety herein by reference.

Figure 5:
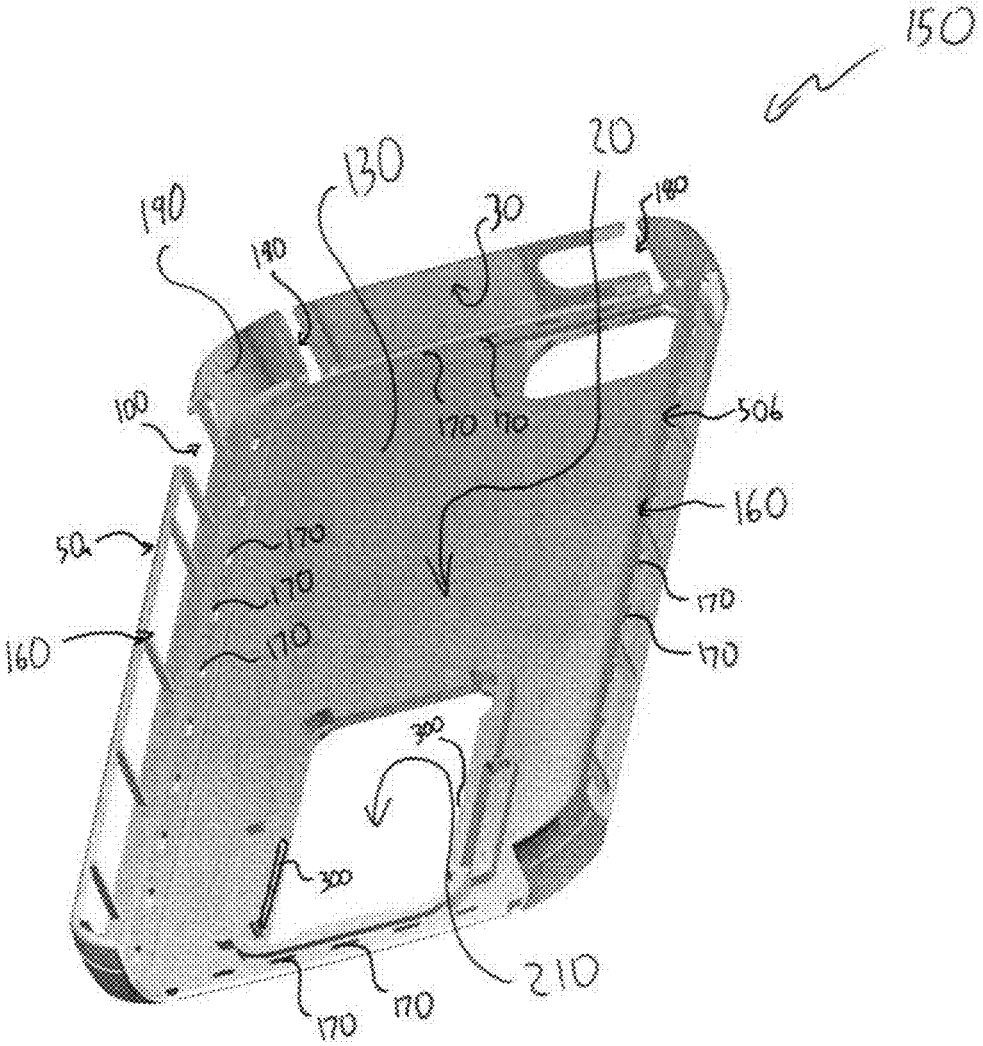
FIG. 5 illustrates a reduced perspective view of the electronic device case of FIG. 1, omitting a material molded therein.

FIG. 5 illustrates an example of a preform 150 comprising the hard material 130 of the case 10. As shown, the preform 150 includes structural components configured to facilitate co-molding of the flexible material 140 thereon. While in some embodiments the preform 150 may be merely partially cured before the flexible material 140 is applied and molded there around, in an embodiment the formation of the preform 150 of the hard material 130 may be complete (e.g. cured, removed from the mold, and/or separately assembled) before being combined with the flexible material 140.

As shown in FIG. 5, in an embodiment the preform 150 includes frame supports 160 that may be at least partially filled and surrounded with the flexible material 140 during assembly of the case 10. In an embodiment, the frame supports 160 may generally provide structural rigidity for the flexible material 140 thereat. It may be appreciated that the flexible material 140 at the sides 50*a* and 50*b* may be shaped to include grooves, decorations, or other features. In an embodiment, some or all of the frame supports 160 may protrude from or otherwise not be covered by the flexible material 140.

In some embodiments, such as that illustrated, the portion of the preform 150 that forms the base 20 of the case 10 may include apertures 170 therein which may provide a path for the flexible material 140 to flow through prior to curing during the co-molding process. Such apertures 170 may therefore allow the flexible material 140 to reach the rear side of the case 10, to form the decorative perimeter illustrated in FIG. 4. As further shown, cutouts 180 may be formed in the preform 150 to space the sides 50*a* and 50*b* from the top 30, which may contribute to the flexibility of the case 10 to expand the opening 60 for insertion of the personal electronic device therein. In the illustrated embodiment, the aperture 100 on the left side 50*a* includes a portion formed from the flexible material 140. Accordingly, the preform 150 may include a corner piece 190 that is separated from the remainder of the left side 50*a* and the top 30, except through the base 20, but is subsequently coupled to the remainder of the left side 50*a* and the top 30 through the addition of the flexible material 140. In the illustrated embodiment, the bottom 40, including the apertures 120 formed therein, is formed from the second material 140. Accordingly, the preform 150 may simply include a receiving space so as to receive the flexible material 140 therein during the co-molding. It may likewise be appreciated that in embodiments where the buttons 110 are formed from the flexible material 140, the preform 150 may simply include receiving spaces so as to receive the flexible material 140 therein, shaped to form the buttons 110. The assembly of the flexible material 140 onto the hard material 130 may vary across embodiments, and it may be appreciated that other assembly methods (including but not limited to the materials being secured together with an adhesive) are possible in some embodiments.

In some embodiments, molding supports may be formed on or otherwise positioned on the preform 150 to facilitate overmolding of the flexible material 140 onto the hard material 130. In some embodiments the molding supports may be configured to cooperate with the mold in the overmolding process. For example, in an embodiment one or more of the molding supports may be configured to position or align a portion of the mold to facilitate injection of the flexible material 140. For example, the preform 150 may include support tabs protruding therefrom at a desired distance, configured to define a maximum application thickness for the overmold of the flexible material 140 onto the preform 150. For example, in an embodiment the support tabs may be positioned on the interior surface 80 of the base portion 20 (e.g., for application of the flexible material 140 thereto). In an embodiment the molding supports may include mold channels configured to facilitate flow of the flexible material 140 to desired regions of the preform 150 prior to curing the flexible material 140. For example, in an embodiment the mold channels may be formed around the perimeter of the back surface of the case 10. In an embodiment, the apertures 170 may extend from the interior surface of the preform 150 to the mold channels.

It may be appreciated that the case 10 described herein includes a stand 200, configured to selectively facilitate holding the portable electronic device in an elevated position on a support surface. While in some embodiments the stand 200 is assembled into other regions of the case 10, in the illustrated embodiment the stand 200 is built into the base 20. As shown in FIG. 5, in an embodiment the base 20 is formed with a stand aperture 210. Specifically, in the illustrated embodiment, the stand aperture 210 is formed in the preform 150. Assembled into the stand aperture 210 may be a movable stand assembly 220, illustrated in greater detail in FIG. 6, which may move relative to the base 20 to form an angle relative thereto.

Figure 6:
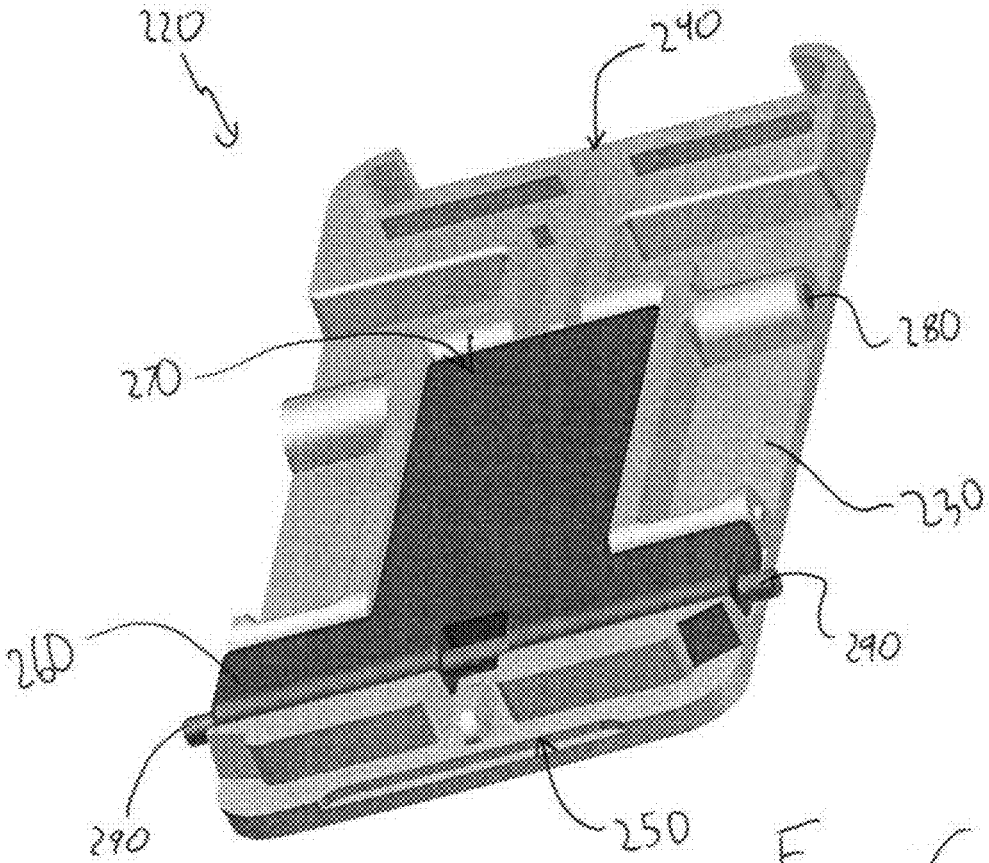
FIG. 6 illustrates a movable stand assembly configured to be assembled into the electronic device case.

While the stand assembly 220 of FIG. 6 may vary across embodiments, in an embodiment the stand assembly 220 includes a support leg 230 configured to be generally flush with the base 20 when the stand assembly 220 is in a closed position, but extend outward from the base 20 when the stand assembly 220 is in an open position. Accordingly, the support leg 230 may form at least three points of contact with the support surface when the stand assembly is in the open position (e.g., with the support leg 230 and either the bottom 40 or one of the sides 50*a* or 50*b*), as described in greater detail below. As shown, the stand assembly 220 may pivot relative to the base 20 at a pivot region 240. Distal from the pivot region 240 may be a support surface engaging region 250. The pivot region 240 and the support surface engaging region 250 are described in greater detail below.

Figure 7:
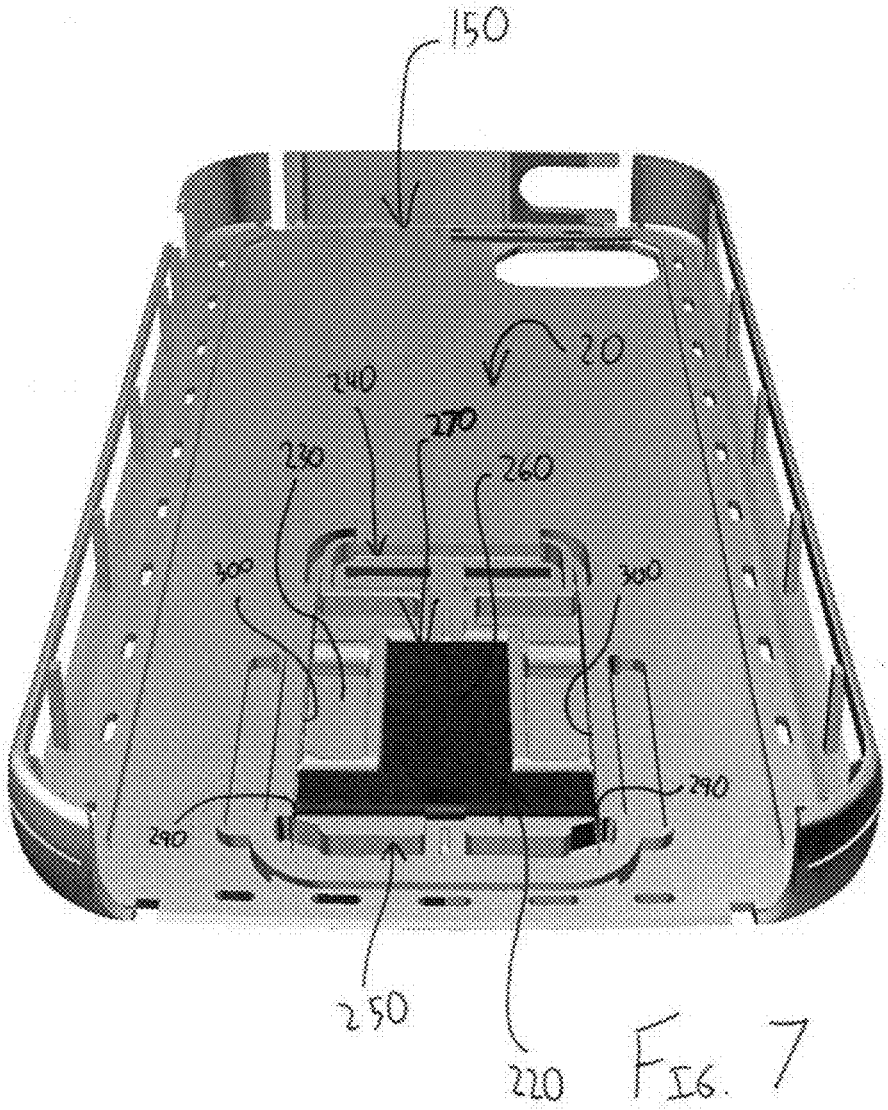
FIG. 7 illustrates a reduced perspective view of the electronic device case of FIG. 1, omitting a material molded therein, but including the movable stand assembly of FIG. 6.

In an embodiment, the stand assembly 220 may include a movable support frame 260, configured to move relative to both the support leg 230 and the base 20 of the case 10, so as to provide additional structural support to the support leg 230, to hold the support leg 230 away from the base 220 when the stand assembly 220 is in the open position, and support the case 10 in the elevated position. As shown in FIG. 6, the movable support frame 260 includes a support leg pivot 270, which in the illustrated embodiment comprises a support pin 280 extending through a portion of the support leg 230 and a portion of the movable support frame 260. In the illustrated embodiment, the movable support frame 260 also includes a base engaging portions 290, which as may be appreciated from FIGS. 4 and 7 may be received in guide tracks 300 formed adjacent to the stand aperture 210. While in some embodiments the base engaging portions 290 may be formed integrally with the movable support frame 260, in an embodiment the base engaging portions 290 may be part of a pin received in the movable support frame 260, having sufficient length to extend into the guide tracks 300.

As described in greater detail below, as the stand assembly 220 is moved into the open position, pivoting at the pivot region 240, the support surface engaging region 250 of the support leg 230 may move outwards away from the base 20, while the movable support frame may pivot at the support leg pivot 270 (via the support pin 280 on the support leg 230), while the base engaging portions 290 slide along the guide tracks 300, to create another point of contact on the support surface. In an embodiment, the guide tracks 300 may include notches therein that the base engaging portions 290 may push past and frictionally lock behind. In an embodiment, a user of the case 10 would utilize additional force to overcome the frictional engagement to move the stand assembly 220 from the open position back to the closed position. Additionally, the frictional engagement may deter or prevent the stand assembly 220 from unintentionally slipping back towards the closed position when the case 10 is supported in a vertical elevated position. While in the illustrated embodiment the notches may be molded into the preform 150, other engagements, including but not limited to spring biased detents, may be utilized to selectively lock the stand assembly 220 into the open position.

In some embodiments, one or more protrusions 310 may be formed on the support leg 230, configured to selectively engage within the guide tracks 300 when the support leg 230 is in the closed position. Such a configuration may deter or prevent the stand assembly 220 from inadvertently moving to the open position, unless a user of the case 10 pulls the support leg 230 away from the base 20, releasing the protrusions 310 from their engagement within the guide tracks 300. Other configurations or engagements are additionally or alternatively possible in some embodiments, including but not limited to spring biased detents, which may be utilized to selectively lock the stand assembly 220 into the closed position. Additionally, while in some embodiments the protrusions 310 may engage within the guide tracks 300 to lock the stand assembly 220 into the closed position, in other embodiments the protrusions 310 may engage other notches formed in the base 20, or elsewhere on the case 10.

Figure 8:
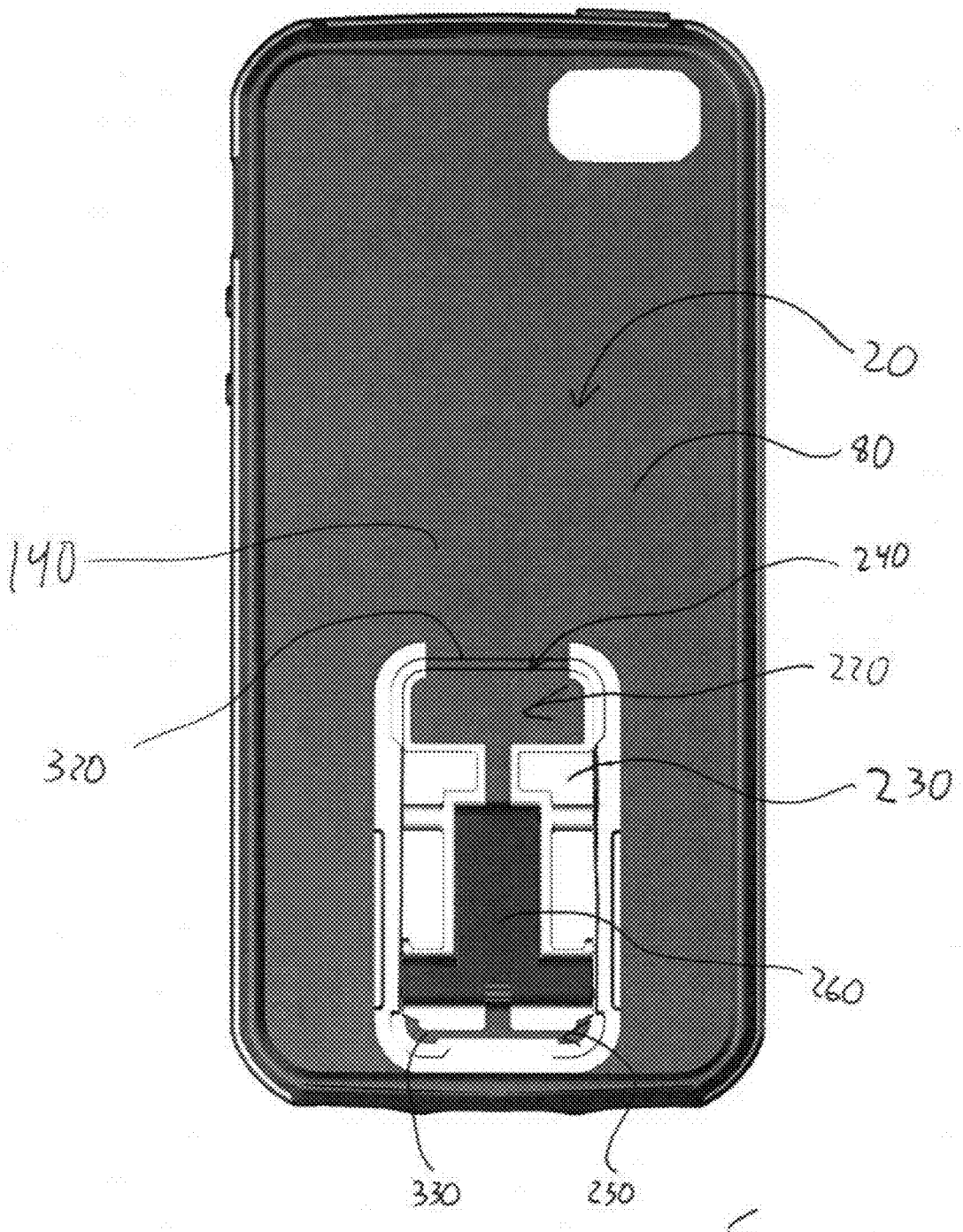
FIG. 8 illustrates a front view of the electronic device case of FIG. 1.

As noted above, the stand assembly 220 pivots relative to the base 20 at a pivot region 240 on the support leg 230. It may be appreciated that the support leg 230 may be coupled to the base 20 via a quantity of the flexible material 140. For example, as shown in the illustrated embodiment, where the hard material 130 is formed as the preform 150, it may be appreciated that the support leg 230 may also be formed from the hard material 130. As depicted in the view of FIG. 8, the flexible material 140 may be positioned at both the interior surface 80 of the base 20, and extend across the pivot region 240, onto the support leg 230, as a flexible hinge 320. Accordingly, the flexible hinge 320 at the pivot region 240 may allow the support leg 230 to pivot or otherwise move relative to the base 20. It may be appreciated that the flexible hinge 320 may be shaped from the flexible material 140 to include grooves therein that may facilitate bending at the pivot region 240. For example, such grooves may be seen at the pivot region 240 in both the view of FIG. 8 facing the interior of the pocket, as well as the view facing the rear of the case 10 in FIG. 4.

In the illustrated embodiment, where the support leg 230 is further coupled to the base 20 via the movable support frame 260, it may be appreciated that at the movable support frame 260 may guide the movement of the stand assembly 220 away from the base 20, and may provide a frictional engagement to prevent the flexible material 140 from biasing the support leg 230 back towards the base 20 (moving the stand assembly 220 back into the closed position).

As further shown in FIG. 8, it may be appreciated that a portion of the flexible material 140 may be positioned at the support surface engaging region 250 of the support leg 230 as a stand grip 330, to provide a grip engagement with the support surface when the stand assembly 220 is in the open position. As noted above, the flexible material 140 may have a higher coefficient of friction than the hard material 130. Accordingly, where the support leg 230 is generally formed from the hard material 130, the flexible material 140 of the stand grip 330 may contact the support surface instead of the hard material 130 at the support leg 230. Accordingly, in embodiments where the bottom 40 is also formed from the flexible material 140, it may be appreciated that the support leg 230 being in the open position may result in multiple spaced points or planes of contact of the higher friction flexible material 140, as described in greater detail below.

Figure 9:
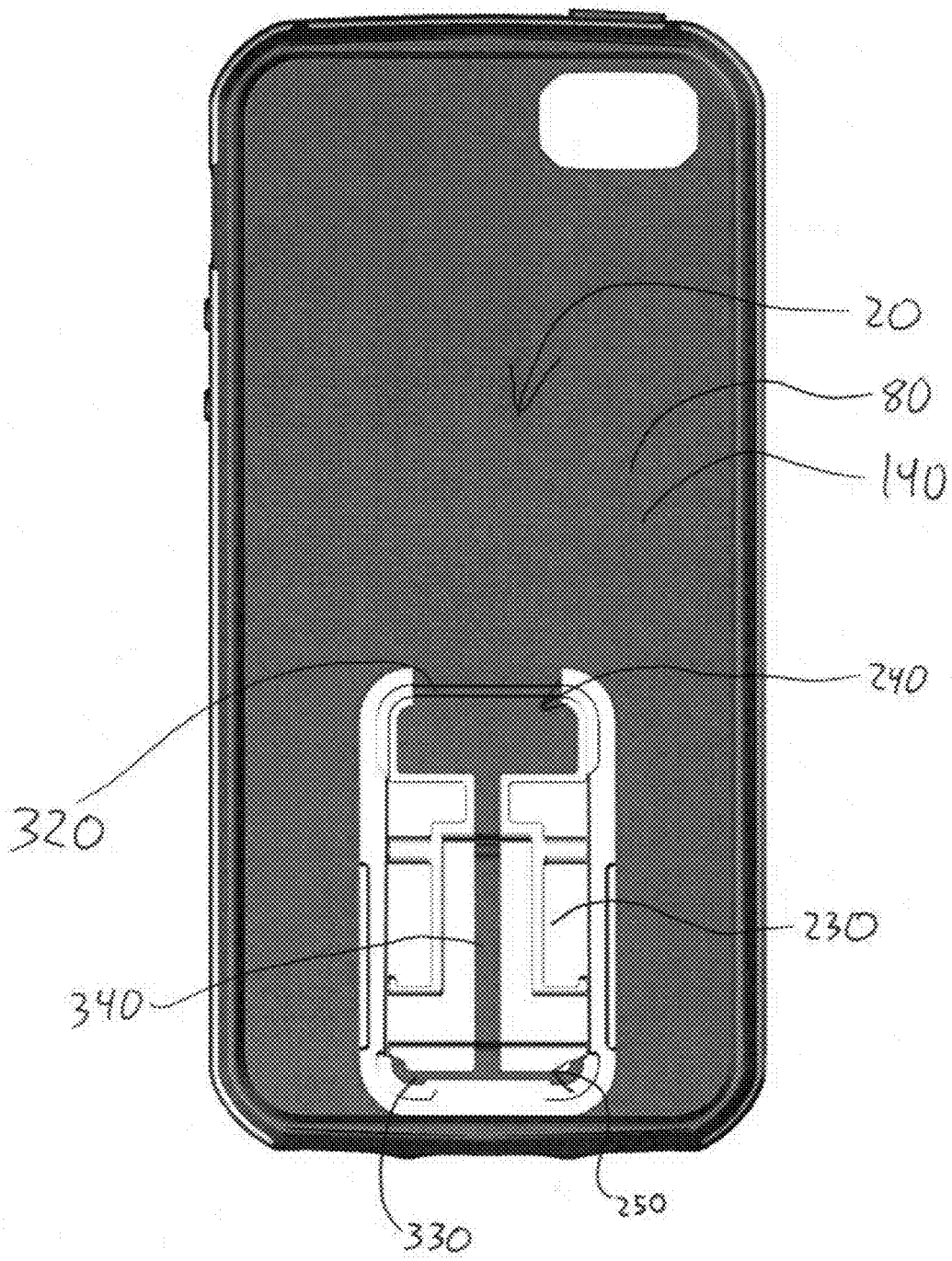
FIG. 9 illustrates a reduced front view of the electronic device case of FIG. 1, omitting components of the movable stand assembly.

It may be appreciated that in some embodiments the flexible material 140 at the support surface engaging region 250 (forming the stand grip 330) may be applied concurrently with the flexible material 140 being molded onto the base 20 of the case 10 (i.e., the flexible hinge 320 and that covering the base 20). For example, FIG. 9 shows a reduced view of the case 10, omitting the support frame 260 (including the base engaging portions 290) and the support pin 280, so that the molding of the flexible material 140 onto the support leg 230 is not obscured. As shown, in an embodiment the flexible material 140 may be molded (e.g., poured and cured) so as to cover the base 20, extend onto the support leg 230 to form the flexible hinge 320, and extend as a strip 340 onto the stand grip 330. In other embodiments, the flexible material 140 at the stand grip 330 may be poured separately from the flexible material 140 at the flexible hinge 320 and/or the base 20. In some embodiments, the flexible material at the stand grip 330 and/or the flexible hinge 320 may be a different material from the flexible material generally positioned in at the interior 80 of the base 20. Accordingly, the illustrated embodiment with the strip 340 coupling the stand grip 330 with the flexible hinge 320 and the flexible material 140 at the interior 80 is merely exemplary, and other configurations are alternatively possible.

In an embodiment, assembly of the case 10 may comprise forming the preform 150 and the support leg 230. The support leg 230 may be formed simultaneously with or separately from the preform 150 in various embodiments. Regardless, assembling the case 10 may comprise placing the support leg 230 in the stand aperture 210 (or otherwise separating the support leg 230 from the preform 150 to form the stand aperture 210). The preform 150 and support leg 230 may then be covered by the flexible material 140 joining the support leg to the preform 150 via the flexible hinge 320. As indicated above, in some embodiments the hard material 130 and the flexible material 140 may be co-molded through co-injection molding (and thus may cure together), while in other embodiments either the hard material 130 or the flexible material 140 may be formed first (and may be at least partially cured), before the other of the hard material 130 or the flexible material 140 is molded thereon. In an embodiment, once the perform 150 and the flexible material 140 are formed together, the movable support frame 260 may be installed thereon. For example, where the base engaging portions 290 are part of a pin received in the movable support frame 260, the pin may be inserted into the movable support frame 260 and aligned with the base engaging portions 290 to be received in the guide tracks 300. The opposite end of the movable support frame 260 may then be aligned with the support leg pivot 270, and the support pin 280 may be inserted into the receiving portion of the movable support frame 260 and the support leg 230, to pivotally couple the movable support frame 260 to the support leg 230.

Figure 10:
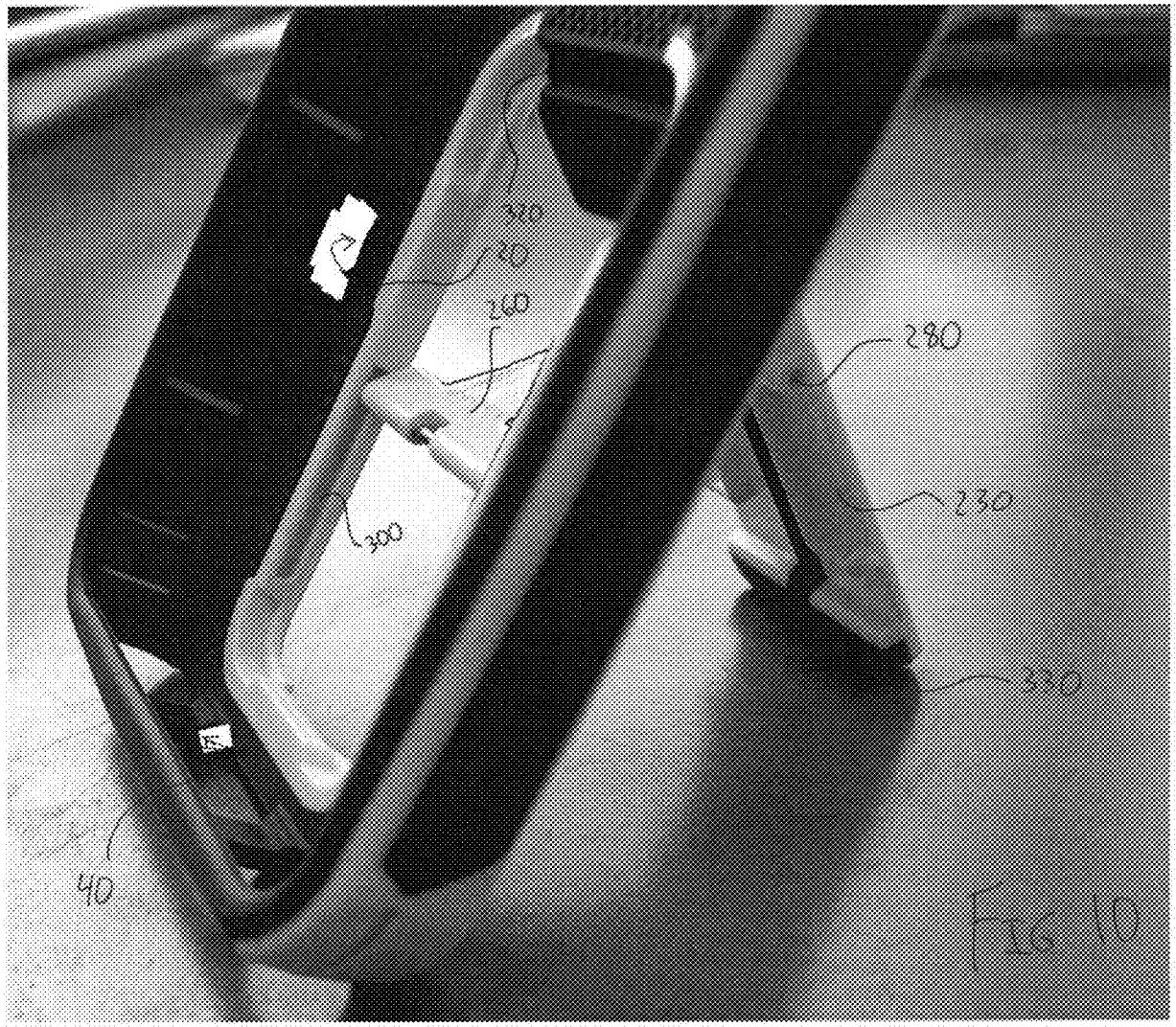
FIG. 10 illustrates a perspective view of the movable stand assembly in an open position from the electronic device case of FIG. 1, supporting the electronic device case in a vertical elevated position.

FIG. 10 illustrates the case 10 with the stand assembly 220 in the open position, configured to support the case 10 in a vertical elevated position. As shown, in some embodiments, when the support leg 230 is pulled away from the base 20, the movable support frame 260 moves relative to the base 20 via the base engaging portions 290 moving along the guide tracks 300 until snapping behind notches formed in the guide tracks 300. At the same time, the movable support frame 260 pivots relative to the support leg 230 via the support pin 280. It may be appreciated that the support leg 230 is coupled to the base 20 via the flexible hinge 320, formed from the flexible material 140. Once the case 10 is positioned in the vertical elevated position, supported by the stand assembly 220 in the open position illustrated in FIG. 10, the stand grip 330 and the bottom 40, each formed from a material (e.g., the flexible material 140) having a higher coefficient of friction than the hard material 130, may provide a stable frictional engagement between the case 10 and the support surface. In some embodiments, such as where the stand grip 330 is formed to face the interior of the case 10 when the stand assembly 220 is in the closed position, it may be appreciated that an angle formed between the base 20 and the support leg 230 when the support leg 230 is in the open position may be sufficiently great so that the stand grip 330 contacts the support surface instead of the side or base of the support leg 230. In an embodiment, such an angle may be determined by one or more of the length or other configuration of the movable support frame 260 and/or the guide tracks 300. Additionally, in an embodiment the flexible material 140, or similar material having a high coefficient of friction, positioned at the bottom 40 or back of the case 10, may extend sufficiently far so as to provide a high friction contact at the body of the case 10. As shown in FIG. 4, for example, the perimeter of the flexible material 140 formed on the back of the case 10 may include portions of flexible material 140 extending towards the bottom 40, which may provide such a frictional contacting surface against the support surface when the support leg 230 is in the open position.

Figure 11:
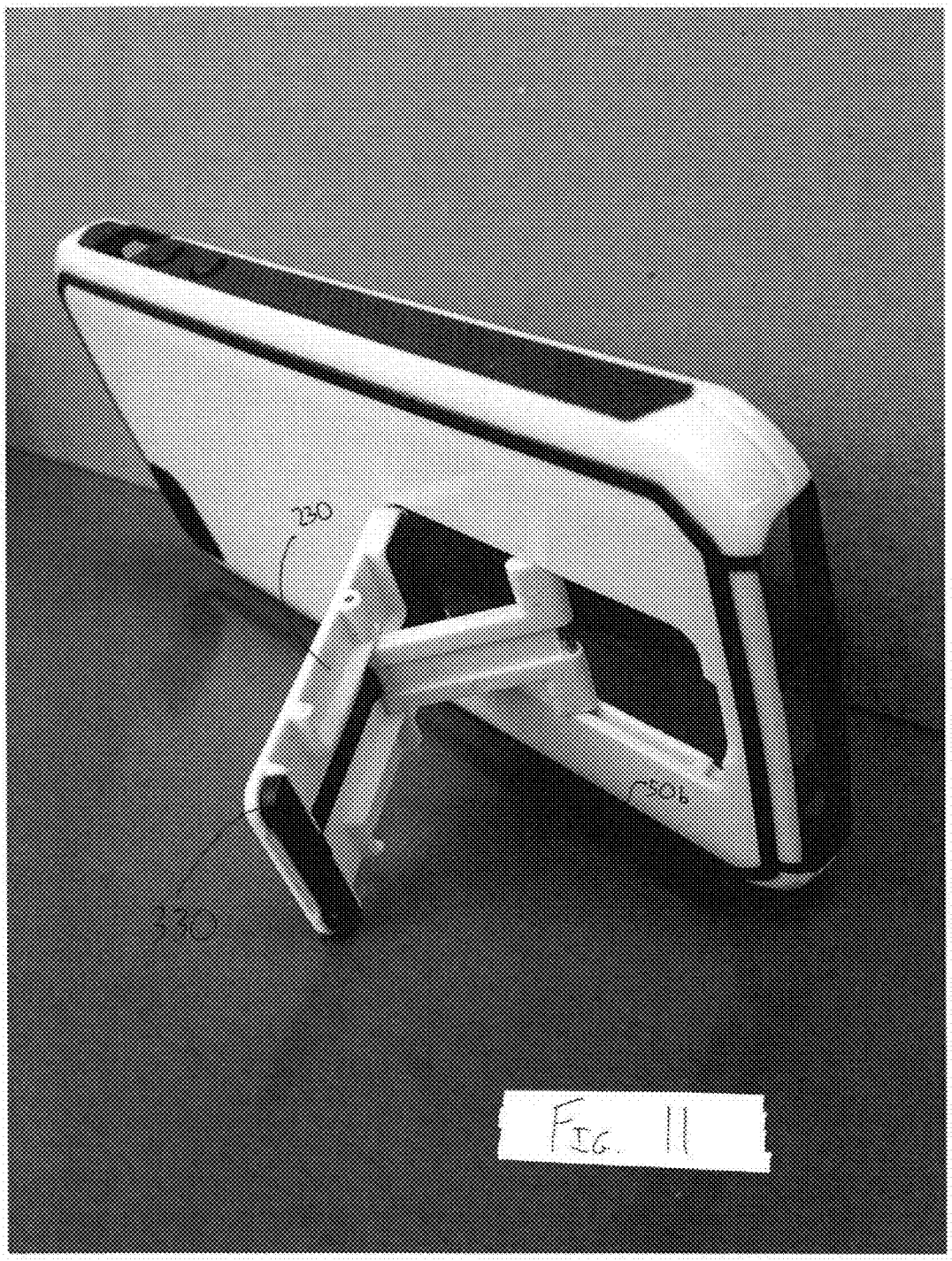
FIG. 11 illustrates a perspective view of the movable stand assembly in an open position from the electronic device case of FIG. 1, supporting the electronic device case in a horizontal elevated position.

It may be appreciated that the case 10 may alternatively be supported in a horizontal elevated position, resting on one of the sides 50*a* or 50*b*, with the support leg 230 in the open position. For example, as shown in FIG. 11, the case 10 may be positioned with the support leg 230 extended while the case 10 is resting on the right side 50*b*. While in some embodiments the flexible material 140 on the sides 50*a* or 50*b* (normally serving as a grip for the user) may provide increased frictional engagement against the support surface, in other embodiments the case 10 may be angled such that the hard material 130 at the sides 50*a* or 50*b* (or the hard material 130 at a corner between the sides 50*a* or 50*b* and the back of the case 10) may contact the support surface. Similarly, while in some embodiments the flexible material 140 at the stand grip 330 may contact the support surface when the case 10 is supported in the horizontal elevated position, in other embodiments the hard material 130 (or similar material) of the support leg 230 may contact the support surface when the case is supported in the horizontal elevated position. It may be appreciated that in some embodiments a lower center of gravity of the case 10 in the horizontal elevated position relative to the vertical elevated position may make the higher frictional engagement of the unnecessary.

It may be appreciated that dimensions of the case 10 may vary according to the type of portable electronic device to be held therein. For example, in some embodiments where the hard material 130 (e.g., as the preform 150) is relatively rigid (especially as compared to the flexible material 140), it may be appreciated that the dimensions thereof may be sufficient to surround the portable electronic device. In an embodiment, the flexible material 140 may be sized to snugly surround the portable electronic device, and may provide impact protection for the portable electronic device within the hard material 130. Additionally, in some embodiments the hard material 130 in the case 10 may be shaped to generally match contours of the portable electronic device. For example, the preform 150 or analogous components of other embodiments of the case 10 may cause the case 10 to generally resemble the portable electronic device. In some embodiments, the case 10 may be formed with the hard material 130 (e.g., as the preform 150) having multiple facets or curves formed on one or more of the base 20, top 30, bottom 40, left side 50*a*, and right side 50*b*. In other embodiments, the case 10 may be shaped in a manner that is externally different from the portable electronic device configured to be retained therein. In some embodiments, the flexible material 140 may be configured to create a pocket shaped to retain the portable electronic device, but may have varying thickness within to fill the space between the pocket and the hard material 130 at the exterior of the case 10. Accordingly, it may be appreciated that the generally straight lines and rounded corners depicted in the case 10 illustrated herein are merely exemplary.

The materials utilized in the case 10 and/or their properties may also vary across embodiments. For example, while in the illustrated embodiment the material 130 utilized in the preform 150 is described as being hard or rigid, in other embodiments the material 130 may be any appropriate material having less shock absorbing properties than the flexible material 140. For example, while both the hard material 130 and the flexible material 140 may be flexible in some embodiments, the flexible material 140 may be more resilient than the hard material 130. It may be understood that resilient materials may include materials that can substantially return to its original form after being stretched, moved, bent, or otherwise deformed (within a reasonable tolerance).

It may be appreciated that in the art, resiliency may be measured by a durometer. Shore A durometers generally measure the compressive deformability of softer materials, such as rubbers and softer polyurethanes, while Shore D durometers may measure compressive deformability of harder polyurethanes and softer plastics. Rockwell R durometers typically measure compressive deformability of harder polyurethanes and plastics, ranging from Teflon through phenolic, for example. Accordingly, in some embodiments the flexible material 130 may have a hardness/resiliency on a scale conventionally measured on a Shore A durometer (e.g., a Shore A durometer value between 20-95), while the hard material 130 may have a hardness/resiliency on a scale conventionally measured on a Shore D durometer of 25-85, or on a Rockwell R durometer of 50-150. In an embodiment, the hard material 130 may be harder or more rigid so as to provide penetrative protection thereto, distributing impact forces applied thereto throughout the hard material 130. The comparative softness and resilience of the flexible material 140 (e.g., having a Shore A durometer value of less than 90) may absorb shocks therein, and give to prevent direct application of forces to the portable electronic device housed therein. It may be appreciated that in some embodiments hardness/resilience and an associated coefficient of friction may be distinct from a coefficient of friction associated with the material and a given reference surface. For example, some harder materials may have a relatively high coefficient of friction, while some softer/resilient materials may have a relatively lower coefficient of friction. Accordingly, the selection of the hard material 130 and the flexible material 140 may vary across embodiments, depending on a desired protruding resilient portion or a desired portion having a higher coefficient of friction.

As such, the material selections of the hard material 130 and the flexible material 140 may vary, and may each have different properties, including but not limited to differing hardness/resiliency, and differing coefficients of friction. It may be appreciated that in some embodiments, the same material may have different hardness's/resiliencies, or different coefficients of friction (e.g., with a particular support surface) depending on how the material is prepared. Regardless, in some non-limiting embodiments, the flexible material 140 may comprise a thermoplastic polymer or a thermoplastic elastomer material, such as thermoplastic polyethylene (TPE) or thermoplastic polyurethane (TPU). Any other resilient material, such as silicone, rubber or foam, may additionally or alternatively be utilized. In contrast, the hard material 130 may be more prone to permanent deformation, including cracking, scratching, shearing, or so on. As one non-limiting example, in the illustrated embodiment, where the hard material 130 is a molded plastic, the hard material 130 may comprise a thermoplastic, including but not limited to thermoplastics such as polycarbonate, acrylonitrile butadiene styrene (ABS), and polyvinyl chloride (PVC). It may be appreciated that the hard material 130 need not be formed from molded plastic, but may comprise any other material, including but not limited to wood, metal, glass, leather, or so on, which may be overmolded with or assembled with a resilient or otherwise impact absorbing flexible material, which may facilitate the flexible hinge 320 between the base 20 and the support leg 230, for example.

In some embodiments, the hard material 130 and the flexible material 140 may have different cosmetic properties. For example, in some embodiments, the hard material 130 may have glossy characteristics, while the flexible material 140 may have matte characteristics. In other embodiments, the converse may be true. In some embodiments, the hard material 130 and the flexible material 140 may be different colors. Additionally, in various embodiments, one or more additional materials may be embedded or combined with either or both of the hard material 130 and the flexible material 140, and may serve cosmetic or functional purposes. For example, different portions of the components of the case 10 described above (e.g., different parts of the preform 150) may be made from different materials, which may be molded or otherwise assembled before being overmolded or otherwise secured to the flexible material 140 and/or additional materials. In an embodiment, the hard material 130 and the flexible material 140 may be secured to each other through a bond (e.g., as in the molding process) or through adhesion (e.g., via an adhesive).

While the principles of the invention have been made clear in the illustrative embodiments set forth above, it will be apparent to those skilled in the art that various modifications may be made to the structure, arrangement, proportion, elements, materials, and components used in the practice of the invention.

It will thus be seen that the objects of this invention have been fully and effectively accomplished. It will be realized, however, that the foregoing preferred specific embodiments have been shown and described for the purpose of illustrating the functional and structural principles of this invention and are subject to change without departure from such principles. Therefore, this invention includes all modifications encompassed within the spirit and scope of this disclosure, including the appended claims.

What is claimed is:

1. A case for use with a portable electronic device, the case comprising:

a first material configured to surround a back portion and side portions of the portable electronic device, the first material generally being positioned at an exterior of the case;

a second material secured to the first material, the second material having greater flexibility than the first material; and a movable stand configured to selectively extend from the first material to support the case in an elevated position;

wherein the movable stand is coupled to the first material by the second material.

2. The case according to claim 1, wherein the movable stand is configured to selectively extend from a back portion of the case.

3. The case according to claim 1, wherein the first material is shaped as a preform member prior to the second material being applied thereto.

4. The case according to claim 3, wherein the second material is over-molded onto the preform.

5. The case according to claim 3, wherein the movable stand is shaped as a second preform member that is spaced from the preform member of the first material and is coupled to the preform member of the first material by the second material.

6. The case according to claim 1, wherein the first material and the second material are molded together.

7. The case according to claim 6, wherein the first material and the second material are integrally molded to form an integral unit.

8. The case according to claim 7, wherein the first material and the second material are molded together through co-injection molding.

9. The case according to claim 1, wherein the second material is bonded to the first material.

10. The case according to claim 1, wherein the case is separable into constituent parts configured to slide relative to each other to surround the portable electronic device.

11. The case according to claim 1, wherein the first material comprises one or more of plastic, polycarbonate, wood, metal, glass, and leather.

12. The case according to claim 1, wherein the second material is formed from thermoplastic polyethylene (TPE), rubber, or foam.

13. The case of claim 1, wherein the first material is glossier than the second material.

14. The case of claim 1, wherein the second material has a higher coefficient of friction than the first material.

15. The case of claim 1, further comprising an amount of the second material at a portion of the movable stand positioned to selectively contact a support surface when the movable stand supports the case in the elevated position.

16. The case of claim 15, wherein the amount of the second material at the portion of the movable stand positioned to selectively contact the support surface is integrally formed with the second material coupling the movable stand to the first material.

17. The case of claim 1, further comprising a movable support frame configured to move relative to both a leg of the movable stand and the first material of the case.

18. The case according to claim 1, wherein an amount of the second material coupling the movable stand to the first material comprises a flexible hinge between the movable stand and the first material.

19. The case of claim 1, further comprising one or more apertures formed in one or more of the first material and the second material, configured to align with features of the portable electronic device.

* * * * *